United States Patent [19]

Diamantides

[11] 4,048,602

[45] Sept. 13, 1977

[54] UNIVERSAL IMPEDANCE POWER APPARATUS

[76] Inventor: Nick D. Diamantides, 2517 14th St., Cuyahoga Falls, Ohio 44223

[21] Appl. No.: 591,297

[22] Filed: June 30, 1975

[51] Int. Cl.[2] ..... H01F 7/08

[52] U.S. Cl. ..... 335/222; 335/249; 336/177

[58] Field of Search ..... 335/223, 222, 229, 243, 335/230, 249, 252; 336/177

[56] References Cited

U.S. PATENT DOCUMENTS

| | | | |
|---|---|---|---|
| 2,263,819 | 11/1941 | Ray | 335/222 |
| 2,548,179 | 4/1951 | Underwood | 336/177 X |
| 3,161,793 | 12/1964 | Laithwaite | 335/222 X |
| 3,247,476 | 4/1966 | Pintell | 335/252 X |
| 3,382,468 | 5/1968 | Mattes | 336/177 X |
| 3,467,925 | 9/1969 | Masuda | 335/222 X |
| 3,484,730 | 12/1969 | McCormick | 335/222 |
| 3,869,930 | 3/1975 | Forest | 335/222 X |

*Primary Examiner*—George Harris

[57] ABSTRACT

The subject matter of the present invention is a universal impedance element of electric power transmission and distribution use, having either fixed or controllable magnitude which, by choosing the value of one structural parameter, can be set to function as an inductor, capacitor, contactless voltage regulator or arcless circuit breaker.

22 Claims, 14 Drawing Figures

UNIVERSAL IMPEDANCE POWER APPARATUS

This invention pertains to equipments used in the field of transmission, distribution and utilization of electric power, and in particular to the area of general impedance implementing devices such as reactors, capacitors, regulators and circuit breakers.

It is known to those versed in this art that the efficient and safe handling and use of a.c. power requires the insertion of devices through which electric current may be filtered against noisy harmonics, power-factor corrected, and interrupted or reconnected, as the need may be, or of devices through which voltage can be regulated and maintained at a predetermined level against continuous load fluctuations.

It is also known that, under the current state of the art, each one of the above different operations is served by devices of drastically different nature and design, such as capacitors, reactors, rotating condensers, circuit breakers, and regulators.

To make such devices available to the utility industry, power equipment manufacturers have to support and maintain separate and diverse manufacturing facilities, and separate inventories of parts and materials at a great inconvenience and cost.

The common characteristic of the aforesaid devices is that they all are impedance elements of either fixed magnitude (capacitors, reactors, circuit breakers) or varying magnitude (rotating condensors, regulators). There is, therefore, a pressing need for the creation of a universal impedance element whose architecture will be common for all functions represented by the aforementioned devices, and which will be made to perform any one of these functions by means of a simple setting or adjustment of an appropriate parameter.

It is the purpose of the present invention to create a universal impedance element which in effect will function either as an inductor, a capacitor, or a resistor, and which therefore we alternately choose to call multimpeder heretofore.

A second purpose of the invention is to make the selection of the multimpeder function a matter of setting the value of a simple parameter.

A third purpose of the invention is to make the impedance value of the multimpeder either resettable in response to an operator command, or continuously changeable in response to a signal generated by the load flow of a particular segment of the power network.

An additional purpose of the invention is to structure the multimpeder so that it will be maintenance-free and long-lived.

A further purpose of the invention is to design the multimpeder so that only a minimum of parts inventory will suffice for its manufacture.

Still another purpose of the invention is to implement the multimpeder so that only a minimum of utility personnel training will be necessary for its installation, adjustment, inspection, and maintenance.

Additional objects of the invention will become apparent upon reading of the following specification, considered and interpreted in the light of the accompanying drawings in which FIG. 1 is a cross sectional view of the preferred implementation of the multimpeder comprising a magnet, an armature, a spring, and centering means in an arrangement of cylindrical geometry.

Figure 9A:
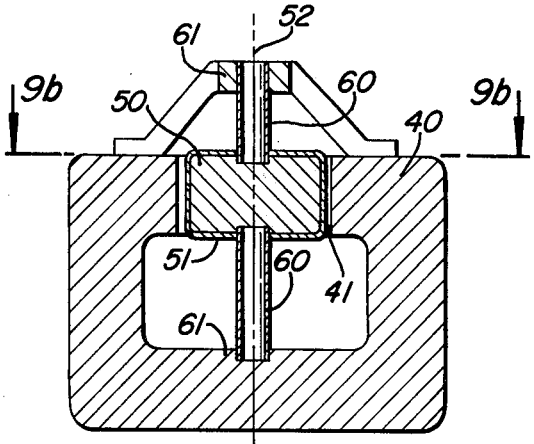

FIG. 9*a* is a cross sectional view of the multimpeder comprising a magnet, an armature and a torsion bar in a planar arrangement.

Figure 9B:
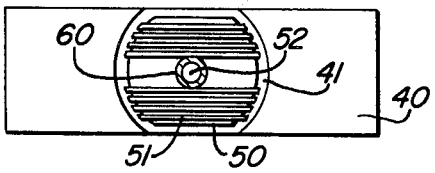

FIG. 9*b* is a plan view of the planar geometry multimpeder.

Figure 10A:
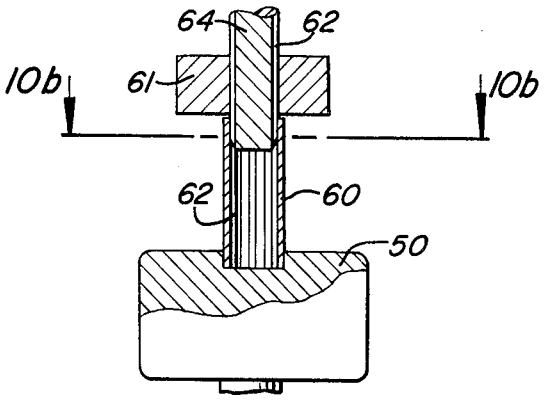

FIG. 10*a* is a partially sectional view of the armature and torsion bar showing an arrangement for changing the spring constant of the system by means of a plunger.

Figure 10B:
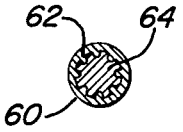

FIG. 10*b* is a cross sectional view of the torsion bar and plunger.

Figure 11:
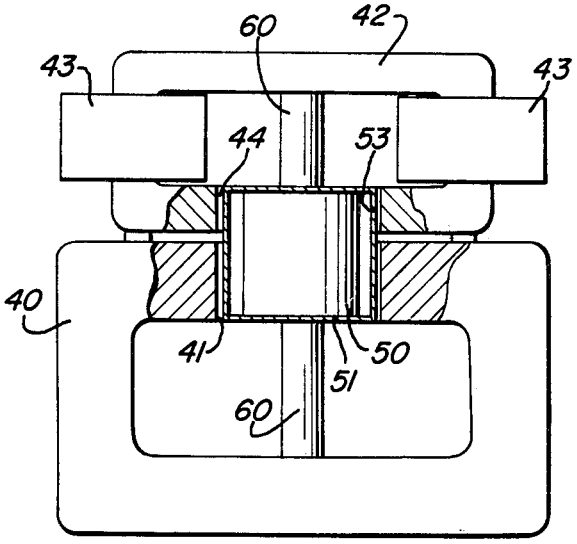

FIG. 11 is a partially sectional view of the planar geometry multimpeder equipped with an electromagnetic feedback member.

Figure 12:
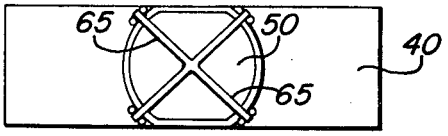

FIG. 12 is a plan view of the multimpeder showing a leaf-spring taking the place of the torsion bar.

Figure 1:
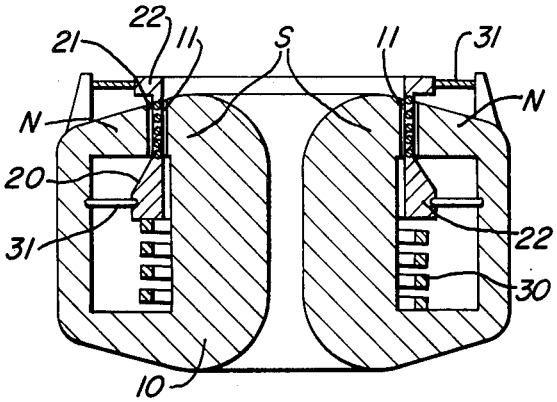

The basic mechanism of my invention is shown in, and the principle governing the operation of it can be derived on the basis of, FIG. 1, where the preferred implementation of the multimpeder is sketched.

The device comprises the cylindrical magnet 10 whose north and south poles N, S are separated by an annular gap 11, and the armature 20 surrounding the center pole S of the aforesaid magnet. The armature has the shape of a cylindrical shell whose part between the poles N, S is made of two end flanges 22 between which is clamped a helical coil 21 with suitably insulated surfaces, through which coil electric current can flow. For the sake of clarity, the two leads, or cables, which bring the current to the coil are omitted from the drawing but, nevertheless, always implied. The armature 20 is supported by a spring 30, and centered by means of centering arms 31 radially placed between magnet 10 and armature, which permit the armature to move up or down but not laterally within the gap 11. Other types of centering means may be used as well without alerting the character of the invention. The gap 11 is filled with a fluid which can be either air, or a ferrofluid whose purpose will be to increase the gap's magnetic permeability, or a viscous ferrofluid which, additionally, applies viscous damping to the armature's motion. The magnet 10, spring 30, armature 20 and coil 21 act cooperatively in response to the presence of an alternating electric current flowing through the coil, and create an electrokinematic system whose behavior determines the impedance characteristic of the device.

The helics of the coil 21 are conductors carrying current *i*, which, in the presence of the magnetic field of density B crossing the gap 11, are acted upon by a force $f$ whose magnitude is:

$$f = Bli, \tag{1}$$

$l$ being the length of the coil. Thus, if $i$ varies sinusoidally with time, so will be the force $f$.

The armature 20 responds to this force $f$ by moving a distance $x$ against the opposition of the spring 30 and of the viscous friction of the fluid in the gap 11.

Two fundamental equations describe the interacting electrical and mechanical phenomena taking place when the coil 21 is subjected to an alternating voltage $$E = E_o\sin(\mathrm{wt})\ \text{volts}, \tag{2}$$

whose amplitude is $E_o$ volts and whose angular frequency is $$w = 2\pi f_o \text{radians/second}. \tag{3}$$

In the case of American power networks, the frequency $f_o$ is 60 hertz, while their European counterparts use $f_o$= 50 hertz.

The two fundamental equations are:

The one describing the armature motion $x$ in response to the force $f$ of equation (1):

$$f = Bli = mx^{(2)} + cx^{(1)} + kx, \tag{4}$$

where $m$ is the mass of the armature, $c$ the coefficient of damping, and $k$ the spring stiffness, and where the parenthesized superscripts of $x$ mean time derivatives of $x$ of the respective order.

The equation describing the current flow in the coil:

$$E = E_o\sin\mathrm{wt} = \mathrm{Li}^{(1)} + \mathrm{Ri} + \mathrm{Blx}^{(1)}, \tag{5}$$

where L and R designate the inductance and resistance whose respective voltage drops oppose E, and where the term $Blx^{(1)}$ is the counterelectromotive voltage created by the coil's moving with a velocity $x^{(1)}$ within the magnetic field B.

The two equations have to be solved simultaneously in order to obtain the instantaneous values of:

- the current $i$,
- the displacement $x$,
- the effective reactance and resistance,
- the power absorbed by the dissipative elements of the device,
- the phase angle between voltage and current,
- the reaction force sustained by the support of the device, and
- the counterelectromotive voltage.

To arrive at the solution, we find $i$ and its first derivative $i^{(1)}$ in terms of $x$ from equation (4) and substitute them in equation (5). Thus, we arrive at the expression:

$$BlE_o\sin(wt) = Lmx^{(3)} + (Lc + Rm)x^{(2)} + (Lk + Rc + B^2l^2)x^{(1)} + Rkx. \tag{6}$$

We know, however, that, because the system is linear, the response of the armature to a sinusoidal force will be sinusoidal motion $x$ of the same angular frequency. Consequently, $x$ can be expressed as $$x = P\sin(\mathrm{wt}) + Q\cos(\mathrm{wt}), \tag{7}$$

where P and Q are presently unknown.

To determine them, we find the derivatives of $x$:

$$x^{(1)} = Pw\cos(\mathrm{wt}) - Qw\sin(\mathrm{wt}),$$
$$x^{(2)} = -Pw^2\sin(\mathrm{wt}) - \mathrm{Qw}^2\cos(\mathrm{wt}),$$
$$x^{(3)} = -Pw^3\cos(\mathrm{wt}) + Qw^3\sin(\mathrm{wt}), \tag{8}$$

and substitute them in equation (6), to obtain:

$$\begin{aligned} BlE\cdot\sin(\mathrm{wt}) &= \\ &= \sin(\mathrm{wt})\,[PRk - Qw\,(Lk + Rc + (Bl)^2) \\ &\quad - PW^2(Lc + Rm) + Qw^3Lm] \\ &\quad + \cos(\mathrm{wt})\,[QRk - Pw(Lk + Rc + (Bl)^2) \\ &\quad - Qw^2(Lc + Rm) - Pw^3Lm]. \end{aligned} \tag{9}$$

Since this equation is an identity, it yields:

$$\begin{aligned} &P[R(k - mw^2) - Lcw^2] \\ &\quad - Qw[L(k - mw^2) + Rc + (Bl)^2)] \\ &\quad = BlE\cdot, \end{aligned} \tag{10a}$$

and $$\begin{aligned} &Q[Rk - mw^2) - Lcw^2] \\ &\quad + Pw[L(k - mw^2) + Rc + (Bl)^2] \\ &\quad = 0. \end{aligned} \tag{10b}$$

Solving the system of equations (10a) and (10b) for the unknowns $P$ and $Q$ results in:

$$P = \frac{H}{G^2 + H^2}\,B1E_o, \tag{11}$$

$$Q = \frac{-G}{G^2 + H^2}\,B1E_o;$$

where $$\begin{aligned} G &= w\,[L\,(k - mw^2) + Rc + (Bl)^2], \\ H &= R\,(k - mw^2) - Lcw^2. \end{aligned} \tag{12}$$

When the values of $P$ and $Q$ are substituted in equation (7) and the indicated trigonometric operations carried out, they result in the expression for the armature motion:

$$x = \frac{B1}{\sqrt{G^2 + H^2}}\,E_o\sin(\mathrm{wt} - \phi),$$

where $$\phi = \arctan\frac{G}{H} = \arctan\left[w\left(L + \frac{Rc + (B1)^2}{k - mw^2}\right) / \left(R - \frac{Lcw^2}{k - mw^2}\right)\right]. \tag{13}$$

Since $x$ is now known, so will be its derivative, and when these are substituted into equation (4), they produce the expression for the coil current:

$$i = \frac{\sqrt{(k - mw^2)^2 + (cw)^2}}{\sqrt{G^2 + H^2}}\,E_o\sin(\mathrm{wt} - \phi + \theta), \tag{14}$$

with $$\theta = \arctan\frac{cw}{k - mw^2}.$$

Knowing $i$ we may find the force, $f_s$, sustained by the support as equal and opposite to the force $f$ exerted on the coil and given by equation (1), i.e., $$f_s = -B1\,\frac{\sqrt{(k - mw^2)^2 + (cw)^2}}{\sqrt{G^2 + H^2}}\,E_o\sin(\mathrm{wt} - \phi + \theta). \tag{15}$$

To find the equivalent reactance, $Y_\bullet$, and resistance, $R_\bullet$, seen by the source of the voltage $E_o$, we divide numerator and denominator of the fraction in the current equation (14) by the numerator and obtain:

$$Y_* = \frac{G}{\sqrt{(k - mw^2)^2 + (cw)^2}}; \quad (16)$$

$$R_* = \frac{H}{\sqrt{(k - mw^2)^2 + (cw)^2}}.$$

When the values of $G$ and $H$ from equations (12) are substituted in the above expressions and both numerator and denominator are divided by $(k - mw^2)$, the outcome is:

$$Y_* = w\,[L + \frac{Rc + (B1)^2}{k - mw^2}] / \sqrt{1 + (\frac{cw}{k - mw^2})^2}, \quad (17)$$

$$R_* = [R - \frac{Lcw^2}{k - mw^2}] / \sqrt{1 + (\frac{cw}{k - mw^2})^2}.$$

The counterelectromotive voltage, $v$, generated across the coil 21, is given by the last term of equation (5) and, therefore, after finding the first derivative of $x$ from equation (13), $$v = \frac{(B1)^2 w}{\sqrt{G^2 + H^2}} E_o \cos(wt - \theta). \quad (18)$$

Finally, the power, $u$, dissipated by the resistive elements $R$ and $c$ of the multimpeder will be:

$$u = R_* I^2 \text{ watts}, \quad (19)$$

where $I$ is the rms value of $i$. Thus, from equations (14) and (16):

$$u = \frac{E_o^2}{2} \cdot \frac{H\sqrt{(k - mw^2)^2 + (cw)^2}}{G^2 + H^2}, \quad (20)$$

or, after substitution of the values of $H$ and $G$ from equations (12)

$$u = \frac{E_o^2}{2}(R - \frac{Lcw^2}{k - mw^2}) \sqrt{1 + (\frac{cw}{k - mw^2})^2} \quad (21)$$

$$/ [w^2 (L + \frac{Rc + (B1)^2}{k - mw^2})^2 + (R - \frac{Lcw^2}{k - mw^2})^2].$$

The key to making the multimpeder a universal impedance element may be found in equations (17).

If the damping coefficient is made negligible, $c$ will be absent from the original system equation (5), which means that in equations (17) its value should be set as $c = 0$. Then, $$Y_* = w\,[L + \frac{(B1)^2}{k - mw^2}], \quad (22)$$

$$R_* = R. \quad (23)$$

At the same time the phase angle $(\phi - \theta)$ between current and voltage, given by equations (13) and (14), becomes:

$$\phi = \arctan (Y_*/R_*). \quad (24)$$

The armature displacement, found from equation (13), is:

$$x = \frac{B1}{\sqrt{w^2 [L(k - mw^2) + (B1)^2]^2 + R^2(k - mw^2)^2}} E_o \sin(wt - \phi). \quad (25)$$

The current through the coil, as found from equation (14), becomes:

$$i = \frac{E_o}{\sqrt{Y_*^2 + R_*^2}} \sin(wt - \phi); \quad (26)$$

the force sustained by the support and derived from equation (15) becomes:

$$f_s = -\frac{B1E_o}{\sqrt{Y_*^2 + R_*^2}} \sin(wt - \phi); \quad (27)$$

the counterselectromotive voltage, found from equation (18) is:

$$v = \frac{(B1)^2 w}{\sqrt{w^2 [L(k - mw^2) + (B1)^2]^2 + R^2(k - mw^2)^2}} E_o \cos(wt - \phi); \quad (28)$$

and, finally, the energy dissipated, found from equation (20) is:

$$u = \frac{R_*}{Y_*^2 + R_*^2} \frac{E_o^2}{2}. \quad (29)$$

In all equations (22) through (29) the crucial term $$J = \frac{(B1)^2}{k - mw^2} \quad (30)$$

is conspicuously present, entering the expression through the equivalent reactance, $Y_*$, and constitutes the system parameter through which the multimpeder is made to act as an inductor, capacitor or circuit breaker. For this reason $J$ will be called the system parameter. Its denominator is a function of the mechanical parameters of the spring-armature system, while its manner is a function of the electrical parameters of the magnet coil system.

The manner in which $J$ determines the character of the multimpeder is shown by the following alternatives:

I. When $$k - mw^2 = 0, \quad (31)$$

that is, when $$k/m = w^2, \quad (32)$$

the mechanical system is in a resonance condition. In this state the value of the overall system parameter $J$ will tend to infinity and so will the equivalent reactance $Y_*$, forcing the current $i$ toward zero. Consequently, under the condition of equation (31), the multimpeder acts as an arcless circuit breaker by creating a counter emf voltage which, from equation (28), and from the fact that the phase angle $\phi$ becomes equal to $\pi/2$, is found to be $$v = E_o \sin wt; \quad (33)$$

and causing the armature to move by an amount $x$ found from equation (25) to be:

$$x = \frac{-1}{(Bl)w} E_o \cos wt. \quad (34)$$

II. For the multimpeder to act as an inductor, it is sufficient to make $$k - mw^2 = \delta > 0, \quad (35)$$

where $\delta$ is a sufficiently small positive number. Since $\delta$ divides into the quantity $(Bl)^2$ it results in a large value of $J$, which make $Y_*$ a large enough inductance to render the resistive part $R_* = R$ negligible.

III. To make the multimpeder function as a capacitor, it suffices to make $$k - mw^2 = -\delta, \quad (36)$$

and $$\delta < (Bl)^2/L. \quad (37)$$

It is noted that in both the inductor and capacitor modes of multimpeder operation the value of the equivalent reactance can be made as large as desired by selecting $k$ and $m$ so that the armature-spring system is close enough to resonance to make $\delta$ sufficiently small.

Equations (31), (35) and (36) will be referred to as the condition of resonance, preresonance and postresonance, respectively, each condition representing a different level of vibratory state of the armature-spring system.

The structuring of the system parameter $J$ determines the multimpeder's potential for, and range of, adjustment and control both in line and off line.

Of the factors involved in the expression for $J$, the armature mass, $m$, and the spring stiffness, $k$, can be changed while the device is in operation, but only through mechanical and, therefore, cumbersome manipulations. For this reason they are to be assumed constant heretofore, with the following exception:

To ensure a minimum of parts inventory, it may be desirable that, for a multimpeder of certain size, the value of the mechanical factor $k - mw^2$, originally set as $$k - mw^2 = \delta > 0 \quad (38)$$

in order to produce the inductive reactance $$Y_* = w\left[L + \frac{(Bl)^2}{\delta}\right], \quad (39)$$

be changeable to $$k - (m + \Delta m)w^2 = \delta - \Delta m.w^2, \quad (40)$$

so that $$Y_* = w\left[L + \frac{(Bl)^2}{\delta - \Delta m \cdot w^2}\right] = -w\left[L + \frac{(Bl)^2}{\delta}\right]. \quad (41)$$

Equation (40) states that the change is to be effected by adding an additional mass $\Delta m$ to the armature 20, while equation (41) states that the multimpeder reactance is changed from inductive to capacitive. The value of additional mass necessary to do this is found from equation (41).

$$\Delta m = \frac{(Bl)^2 + L\delta}{(Bl)^2 + 2L\delta} \cdot \frac{2\delta}{w^2}. \quad (42)$$

However, since $$L\delta << (Bl)^2, \quad (43)$$

the additional mass is $$\Delta m = \frac{2\delta}{w^2} = 2\left(\frac{k}{w^2} - m\right). \quad (44)$$

Along similar lines, and instead of the condition depicted by equation (40), it may be desirable that the additional mass be sufficient to only change the mechanical factor from its original value given by equation (31) to the condition of resonance, i.e., $$k - (m + \Delta m)w^2 = 0, \quad (45)$$

or $$k - mw^2 - \Delta m.w^2 = \delta - \Delta m.w^2 = 0,$$

and, therefore, $$\Delta m = \delta/w^2 = (k/w^2 - m). \quad (46)$$

The same unit, therefore, originally set to function as an inductor, may be changed either to a circuit breaker by adding an additional mass $\delta/w^2$ to the armature, or to a capacitor by making this additional mass equal to $2\delta/w^2$.

Hence, the structure of the multimpeder is such as to make readily achievable one of the principle aims of its design, i.e., that of a drastically reduced parts inventory.

Figure 2:
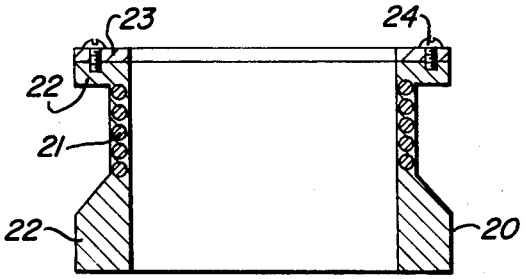
FIG. 2 is a detailed cross sectional view of the armature.

FIG. 2 shows one method of implementing this impedance change. The additional mass $\Delta m$ is made into a ring 23 which is affixed to the top flange 22 of the armature 20 by means of screws 24.

While armature mass, $m$, and spring stiffness, $k$, are convenient factors for factory setting of the multimpeder's impedance species and rating, it is primarily through the flux density, B, of the magnet 10 that continuous rating can be effected.

The bulk of the flux density can be established by making the magnet 10 an electromagnet fed by a continuous current of constant polarity. This method, however, carries with it the penalty of continuous power expenditure, in addition to the need for a rectifier and filter, although the method is included in the claims of the present device for the sake of completeness.

Figure 3:
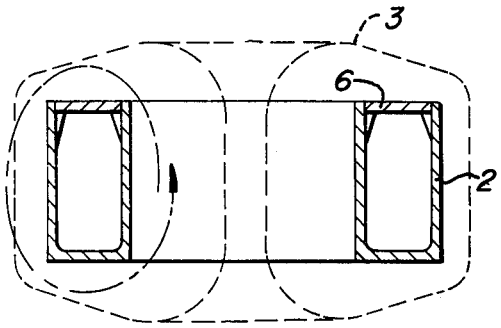
FIG. 3 is a diagram explaining a method of structuring the magnet as to have a cylindrical form, by winding a magnetizeable wire around a toroid core.
Figure 4:
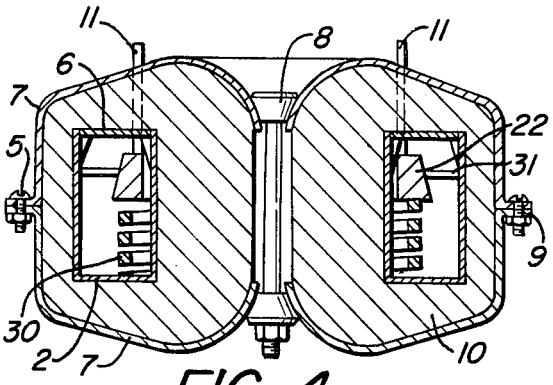
FIG. 4 is a cross sectional view of the magnet assembly produced by the aforesaid method of structuring the magnet.

A more advantageous and, therefore, preferable method of establishing the flux density B within the gap 11 is by making the magnet 10 a permanent magnet, of shape and material ensuring high residual flux density and coercive magnetic intensity such as the material bearing the trade name Alnico V made by the General Electric Company. Conventional techniques of casting and hardening the magnet 10 may be used, These will require that the magnet be made of more than one part in order to allow for the inclusion of the spring 30 and centering means 31 within the magnet during assembly. This, however, entails the presence of gas at the joints between parts in spite of expensive machining of the contacting surfaces, gaps which increase magnet reluctance and, therefore, weaken the magnet. In addition, the thickness of the magnet's body hampers uniform hardening of the metal during quenching that follows heat treatment, and impairs magnetic retentivity. A cheaper and yet better and stronger magnet 10 will result if the magnetic material is made into a wire at first coiled onto a storage spool, from which the wire is wound around a hollow inner form 2, FIG. 3, having the shape of a toroid. The magnet is built by the successive layers of wire deposited on the inner form 2 to form a torus of the desired thickness shown by its outline 3. An electrically insulating adhesive substance may be used to coat the wire while being wound on the inner form 2, the latter having a removable lid 6 that permits the insertion of the spring 30 and centering mechanism 31 before the initiation of the winding processes. The equipment needed to do the winding exists, and has been used in winding toroid inductors for electronic applications. The final step of building the magnet is the placing of the two-piece outer form 7 on the toroid 3 as shown in FIG. 4, and the tightening of the latter by means of central stem 8 and peripheral screws 5 through the flange 9 with which each of the pieces of the form 7 is equipped. The form 7 is also made of magnetizable material similar to that of the wire. After the magnet has been bult in the fashion, the air gap 11 is cut through the upper half of form 7, wire mass, and lid 6 by means of a milling machine or similar power tool. The material of the wire, being permanently magnetizable, can be magnetized either during winding or after the completion of the magnet and the placing of the armature 20 in the gap 11, by means of a high intensity current pulse sent instantaneously through the coil 21. The web like structuring of the magnet's body and the absence of joints and gaps orthogonal to the path of the flux B make for a much more powerful magnet 10 than if conventionally built. In case the magnet 19 is to be electromagnet, the wire will be of soft iron and the electric coil energizing the magnet while in operation will be included into the inner form 2, along with the spring 30 before the winding of the magnet's body begins. For obvious reasons, a magnet so constructed will be referred to as a wire wound magnet.

As already said, the magent 10 provides the bulk or base level of the magnetic flux B through which the magnitude of the multimpeder's reactance $Y_*$ is set, as given by equation (22). This magnitude may be varied within a given range by varying the effective value of B, the relationship between the two variations $\Delta Y_*$ and $\Delta B$ being found from the differential of $Y_*$:

$$\Delta Y_* = w\frac{(Bl)^2}{k - mw^2}\cdot\frac{2\,\Delta B}{B}. \tag{47}$$

Assuming L in equation (22) to be small by comparison with the J term, we have that $$\frac{\Delta Y_*}{Y_*} \simeq 2\frac{\Delta B}{B}. \tag{48}$$

Hence, for a $\pm 10$ percent change in reactance, which is the range expected of voltage regulators, for instance, only $\pm 5$ percent change in flux density is needed.

Figure 5:
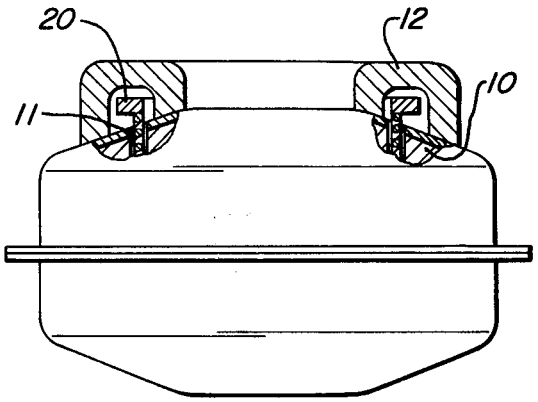
FIG. 5 is an elevated view of the cylindrical geometry multimpeder equipped with a controllable magnetic leakage member.

Reactance control through B, or $(Bl)$, may be effected in a number of ways as exemplified by the following implementations:

A. The factor B may be made effectively $$B = 0, \tag{49}$$

not by demagnetizing the magnet 10, but by bypassing the air gap 11 through the use of a soft iron bridge 12, FIG. 5, across the poles of the magnet. As long as the bridge remains in place, the armature 20 is not acted upon by an electromagnetic force $f$, the mass-spring mechanical system is rendered inactive and the coil 21 behaves as a passive conductor. However, the sudden removal of the bridge from the poles of the magnet 10, by releasing a pre-armed spring mechanism, for instance, will restore the flux B through the gap 11 and a circuit breaker action will ensue, provided that the multimpeder has been preset so that the resonance condition (equation 31) holds.

Figure 6:
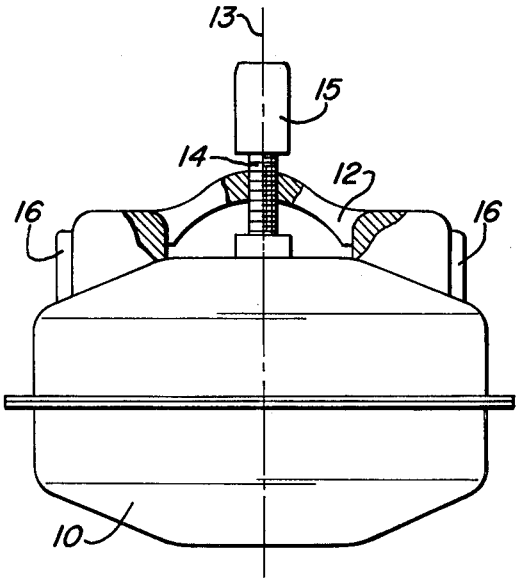
FIG. 6 is an elevated view of the cylindrical geometry multimpeder and of the control mechanism for positioning the magnetic leakage member.

It must be quite obvious that the use of the bridge 12 across the poles of the magnet 10, amounts, to the insertion of a leakage path in the magnetic circuit, insertion that can be implemented in many other ways. It must be obvious, also, that controlling the flux density B inside the gap 11 by means of a leakeage path can be continuous, by moving the bridge 12 nearer to, farther from, or in contact with, the poles of the magnet 10. Either purely mechanical or electromechanical means may be used to cause such movement. Control of $B$ in this fashion can be fast and effective because the magnetic reluctance of the leakage path is quite sensitive to changes in distance between the bridge 12 and the magnet 10. FIG. 6 shows one method of continuous leakage path control whereby the bridge 12 can be moved along the geometric axis 13 of the magnet 10 by means of a screw 14 turned in either direction by a servomotor 15 while the guides 16 prevent the rotation of the bridge 12 itself.

Figure 7:
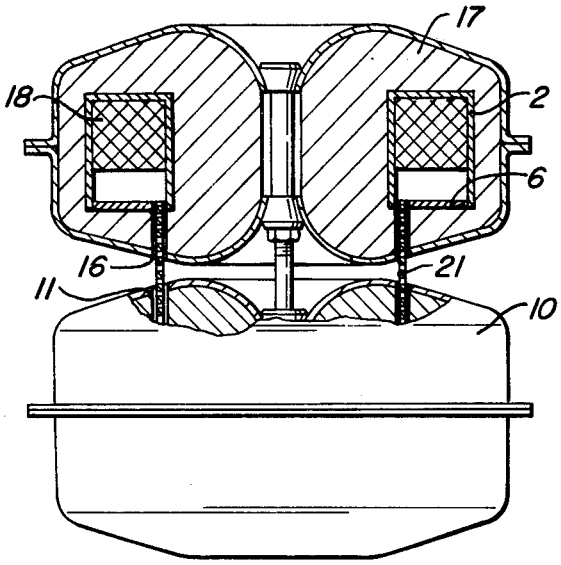
FIG. 7 is a partially sectional view of the cylindrical geometry multimpeder equipped with an electromagnetic feedback member.

B. The product $(bl)$ may be changed to Bl)

$$B_*l_* = Bl \pm B_o l_o, \tag{50}$$

by including a feedback means supplying the change $$\Delta B = \pm B_o l_o, \tag{51}$$

as shown in FIG. 7. The arrangement involves the lengthening of the coil 21 by an amount $l_o$ beyond the main air gap 11, and the subjection of this additional coil length to a controllable magnetic flux $B_o$. The latter flux is generated in the air gap 16 of the feedback electromagnet 17 whose energizing coil 18 is supplied by a variable current whose magnitude and polarity are externally controllable either by a human operator, or by an automatic sensing device responding to a monitored variable such as the line voltage, for instance. Thus, $B_*l_*$ and, therefore, the magnitude of the impedance $Y_*$ can be changed continuously according to need.

Of course, other arrangements for effecting $\Delta B$ are possible, besides the one shown in FIG. 7, for those versed in this art.

Such continuous control of $Y_*$ as described above endows the multimpeder with the capability of assuming the function of a rotating condenser, or of a voltage regulator.

The rotating condenser function is evidenced by the fact that $Y_*$ is controllable by means of a current in the feedback means. The voltage regulator capability, on the other hand, becomes obvious if it is recalled that the need for regulation arises when current, demanded by the loads that are supplied by a distribution line (feeder), flows through the equivalent impedance of a subtransmission line which, as a rule, consists of a resistive and inductive part. The loads themselves, in the great majority of cases, are inductive reactances, also. Consequently, at the substation where the feeder originates, and in the absence of regulatory action, the amplitudes of the feeder current and voltage will be:

$$I_2 = \frac{E_o}{\sqrt{(L_1 + L_2)^2 w^2 + (R_1 + R_2)^2}}, \quad (52)$$

$$E_2 = \frac{\sqrt{L_2^2 w^2 + R_2^2}}{\sqrt{(L_1 + L_2)^2 w^2 + (R_1 + R_2)^2}} E_o,$$

where $R_1$, $L_1$ and $R_2$, $L_2$ are the resistance and inductance elements associated with the subtransmission and feeder lines respectively.

Of concern in this instance is the restoration of $E_2$ to at least the level $E_o$ through regulation. Since regulation in this case will be counteracting the voltage effect of inductive elements, it will be appropriate to use a capacitive multimpeder to achieve the restoration goal. Hence, if the multimpeder were to be connected in series with the out-going feeder, the feeder load will become part of the reactance $R_*$, $Y_*$, or, to put it another way, $R_2$ and $L_2$ in equations (52) will have to be replaced by $$(R_2 + R) \text{ and } (L_2 + L - \frac{(Bl)^2}{\delta}),$$

and $(Bl)^2/\delta$ will have to be continuously adjusted so that $E_2 = E_o$. When these resistance and reactance values are substituted in the second equation (52) and the restoration condition $E_2 = E_0$ imposed, the necessary value of $(Bl)^2/\delta$ emerges as $$\frac{(Bl)^2}{\delta} = \frac{L_1 + 2(L_2 + L)}{2} + \frac{R_1}{L_1 w^2} \cdot \frac{R_1 + 2(R_2 + R)}{2}. \quad (53)$$

As the feeder load varies continuously so do $L_2$ and $R_2$, which means B will have to vary accordingly, either by means of the leakage path control arrangement of FIG. 6, or by means of the current feedback arrangement of FIG. 7. In either case, the difference between $E_2$ and $E_o$ will have to be sensed by means of a Zener diode static sensor bridge, for instance, as is commonly done in present day regulators.

Of interest will be the effect of the regulation action described by equation (53) upon the phase angle between the feeder current $I_2$ and voltage $E_2$, $$\phi_2 = \arctan L_2 w / R_2, \quad (54)$$

which, with the insertion of the regulator, becomes:

$$\phi_2 = \arctan \frac{[L_2 + L - (Bl)^2/\delta]\, w}{R_2 + R}, \quad (55)$$

or, because of equation (53), $$\phi_2 = -\arctan \frac{[L_1 + \frac{R_1(R_1 + 2(R_2 + R)}{L_1 w^2}]\, w}{2(R_2 + R)}. \quad (56)$$

To the extent that the fraction of equation (56) is smaller than the fraction of equation (54), regulation also improves the power factor for the feeder. This is very likely the case because, on the one hand, the fractional term in the numerator is rendered insignificant by the factor $w^2$, and, on the other, the line reactance $L_1$ is normally much smaller than the load reactance.

Power factor correction is another function readily accomplished. Again a series connection to the load $R_2$, $L_2$ will be assumed, while $E_o$ will now represent the service voltage at the load. Consequently, equations (22) through (26) are directly applicable to the case, provided that $Y_*$ and $R_*$ are replaced by $L_2 + Y_*$ and $R_2 + R_*$. Therefore, the phase angle reduces to $$\phi = \arctan \frac{[L_2 + L - (Bl)^2/\delta]\, w}{R_2 + R}. \quad (57)$$

All that is required to obtain a unity power facotr will be to maintain the condition $$(Bl)^2/\delta = L_2 + L, \quad (58)$$

i,e,, to vary $B$ in response to the variations of $L_2$. The most direct way of sensing the condition $\phi + 0$ is to use a phase angle sensor in order to provide the feedback signal for controlling $B$.

One important fact of this arrangement is that the multimpeder acts as a capacitive element only as long as there exists a load current. Thus, it can cause no var flow into the power system as an ordinary capacitor would. In this respect the multimpeder exhibits the merits of a rotating condenser.

A parallel connection between load and multimpeder for power factor correction may be arranged as well.

This concludes the explanation of the multimpeder's inherent nature as a universal impedance element capable of functioning as a capacitor, reactor, regulator and circuit breaker without a change in the unit's basic structural design.

It is emphasized that the foregoing discussion does not purport to be an inclusive elucidation of all possible modes of operation or applications of the multimpeder, nor does it claim that in the examples cited the optimum use of the multimpeder was made.

It is also remarked that the analysis dealt with one phase of the three phase power arrangement, the implication being that three similar multimpeder units, one per phase, will be needed to serve a three-phase system.

Figure 8:
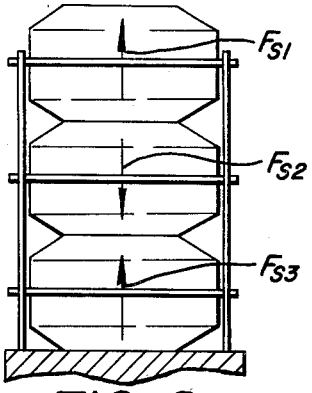
FIG. 8 is a diagram explaining the elimination of support vibration in a three-phase arrangement of the multimpeder.

When this is the case, the simple column arrangement of the three multimpeder units 101, 102, 103 shown in FIG. 8 cancels out the alternating component of the force exerted by the column upon its supports provided that the axes of geometrical symmetry of all three units are colinear. When the three units are arranged so that their geometric axes coincide as shown in FIG. 8, then the aforesaid alternating force component, F, is the algebraic sum of the individual forces $f_{s1}$, $f_{s2}$, $f_{s3}$, where the numerical subscripts indicate the corresponding phases. However, following the phase voltages, the three forces will be 120° out of phase with respect to each other; i.e., using equation (27), $$F = f_{s1} + f_{s2} + f_{s3} \quad (59)$$

$$= -\frac{BlE_o}{\sqrt{Y_*^2 R_*^2}} [\sin(wt - \phi) + \sin(wt - \phi + 120°) + \sin(wt - \phi + 240°)].$$

When the indicated trigonometric additons are performed, the quantity within the brackets reduces to zero; and, therefore, $$F = 0, \tag{60}$$

meaning that no alternating force is exerted n the supports. Hence, vibration and noise are minimized.

So far the kinematics of the multimpeder involves a translational motion of its mechanical components. It is important to appreciate, however, that an equally satisfactory arrangement of the multimpeder structure can be achieved in which the mechanical components move in rotation. A preferred implementation of such an arrangement is shown in FIGS. 9*a* and 9*b*, where the horseshoe-shaped permanent magnet 40 creates a magnetic field of density B in the cylindrical air gap 41. The armature 50, made of magnetic material and having the shape of a cylindrical segment carries the main coil 51, whose loops are wound on the armature 50 in planes parallel to the axis of the cylinder.

The armature 50 is held in place by the two hollow torsion bars 60 which act both as springs and as centering means.

When an alternating current is passed through the main coil 51 in the presence of the magnetic field B, a force $f$ is generated in the conductor segments lying within the air gap 41. The magnitude of this force is given by equation (1) with 1 designating the total length of the aforesaid conductor segments. When this force is referred to the axis 52 of the system's cylindrical symmetry, it produces a torque $$T = fr = Blri, \tag{61}$$

where $r$ is the radial distance of the gap 41 from the axis 52.

The torque $T$ causes the armature to oscillate angularly by an amount of q radians, the equation of the motion being $$T = Blri = Mq^{(2)} + cq^{(1)} + kq, \tag{62}$$

where $M$ is the polar moment of inertia of the armature assembly, $c$ the damping coefficient, and $k$ the torsion spring constant.

Comparison of equation (62) to equation (4) shows that their analytical constitution is identical, with the difference that the mass m in the former is replaced by the moment of inertia in the latter.

Correspondingly, equation (5) describing the current flowing through the coil 51 is replaced by $$E_o \sin wt = Li^{(1)} + Ri + Blrq^{(1)}. \tag{63}$$

Obviously, all analytical expressions represented by equations (1) through (52) derived for the translational type of multimpeder, hold mutatis-mutandis for the torsional type also, provided that forces are replaced by torques, masses by inertias, linear displacements by angular displacements, and the magnetic coupling term $Bl$ by $Blr$.

Consequently, the system parameter J given by equation (30) becomes now $$J = \frac{(Blr)^2}{k - Mw^2}, \tag{64}$$

and the conditions of preresonance, resonance, and post resonance, given by equations (31), (32), (35), (36) and (37), remain valid.

However, the torsional implementation of the impeder offers one additional way of controlling the impedance species of the impeder (capacitive, inductive or practically infinite), and that is the torsion spring constant $k$.

The torsion spring constant, defined as torque per unit of twist angle, is given by $$k = Gm_o/h, \tag{65}$$

where $M_o$ is the polar moment of inertia of the cross section of the bar 60, $h$ the length of the bar, and $G$ the modulus of shear of the material the bar is made of.

Consequently, given $G$ and $M_o$, the constant $k$ can be set and/or controlled by varying the length of the bar 60 between the support 61 and the armature 50. One technique accomplishing this is diagrammed in FIGS. 10*a* and 10*b*, where the hollow bar 60 is shown having its internal surface equipped with splines or grooves 62 parallel to the axis of the bar. A plunger 64 having its outer surface similarly splined connects the bar 60 to the support 61 and can be either inserted in or retracted from the bar telescopically. In doing so, it varies the effective length $h$ of the bar, thus determining the value of $k$. Other means of varying the length $h$ can be envisioned by those versed in this art.

While the aforesaid means of controlling the torsion spring constant are of mechanical nature, it is also possible to control the system parameter J by purely electromagnetic means, as seen in FIG. 11. A horseshoe-shaped feedback electromagnet 42, placed in parallel to the permanent magnet 40, influences the segment 53 of the main coil 51 extended for this very purpose into the air gap 44 of the electromagnet. This arrangement is analogous to that in FIG. 7 of the linear motion type of multimpeder. As in the latter case, the coil 43 energizing the electromagnet 42 is supplied with variable current whose magnitude and polarity are externally controllable either by a human operator or by an automatic sensing device responding to a monitored variable such as line voltage, for instance.

Combining the plunger arrangement of FIG. 10*a* and the feedback magnet arangeent of FIG. 11 renders the ultimate flexiblity to the multimpeder making it capable of changing instantly from capacitor to inductor, regulator, or circuit breaker or anything in between, while in operation. For instance, the device may be set to function as a regulator via the electromagnet 42, i.e., via feedback means not involving moving mechanical parts. At the same time it may be called upon periodically to operate as a circuit breaker by means of the plunger suddenly made to change the spring constant $k$ from a position satisfying equation (35) to a position satisfying equation (31). Specifically, the regulation function is subject to the condition given in equation (53), and repeated here for the rotational multimpeder $$\frac{(Bl)^2}{\delta} = \frac{L_1 + 2(L_2 + L)}{2} + \frac{R_1}{L_1 w^2} \cdot \frac{R_1 + 2(R_2 + R)}{2}, \tag{66}$$

$$K - Mw^2 = \delta < 0. \tag{67}$$

These conditions make the fraction in the second equation (52) equal to unity, which in turn changes the first equation (52) to:

$$I_2 = \frac{E_o}{\sqrt{\left(L_1 + L_2 + L - \frac{(Blr)^2}{\delta}\right)^2 w^2 + (R_1 + R_2 + R)^2}}. \tag{68}$$

While regulation is effected by changing the value of (Bl) circuit breaking may be accomplished by changing the vlue of $\delta$ to $$k - Mw^2 = 0. \quad (69)$$

This results in $I_2 = 0$, and may be accomplished upon command by means of the movable plunger (64). The command may be either the result of an independent decision, or the result of a fault: For instance, a feeder fault will result in a sudden reduction of $L_2$ and $R_2$ and an abrupt increase of $I_2$. This current increase, sensed by an appropriate sensor will cause the command.

To make the circuit interruption permanent a mechanical interrupter of minimal rating, in series with the multimpeder will have to be opened shortly after the condition (69) was achieved. To re-establish the circuit, the interrupter will be closed while the condition (69) is maintained. This step will be followed by reverting to the condition (67), thus restoring the multimpeder to its regulatory function.

The inrush current occurring upon reclosing the interruper may be found by obtaining the Laplace transforms of equations (4) and (5) as applied to the rotational case:

$$(Blr)\, I = (Ms^2 + k)\, Q, \quad (70)$$

$$E_o \frac{w_r}{s^2 + w^2} = (Ls + R)\, I + (Blr)\, s\, Q,$$

where $s$ is the Laplace operator and $I$ and $Q$ the transforms of the current $i$ and armature displacement $q$.

By replacing $Q$ in the second equation by its value found from the first, we find $$I = E_o \frac{w\,(Ms^2 + k)}{[(Ms^2 + k)\,(Ls + R) + (Blr)^2 s]\,(s^2 + w^2)}. \quad (71)$$

In accordance with the initial value theorem of the transformation calculus, the initial value $i_o$ of the current upon reclosing will be $$i_o = \lim_{s \to \infty} (sI), \quad (72)$$

or $$i_o = \lim_{s \to \infty} \frac{w\,(Ms^2 + k)\, s}{8\ (Ms^2 + k)\,(Ls + R) + (Blr)^2 s]\,(s^2 + w^2)}. \quad (73)$$

However, the right hand member limit is zero because the denominator of the fraction is of the fifth degree with respect to $s$, while the numerator is of the third degree. Hence, $$i_o = \mathbf{O}, \quad (74)$$

meaning negligible inrush current upon reclosing.

Some additional comments:

Either magnet 40 or 42 can be made wire wound. Also, the effect of stacking three multimpeder units with their axes colinear in the manner of FIG. 8 upon support vibration, effect expressed by equation (60), holds true in the case of rotational type multimpeder.

On the other hand, torsion springs other than the torsion bar 60 may be used, one of them being the leaf spring arrangement 65 of FIG. 12. Also, both air gaps 41 and 44 may be filled with a ferrofluid in order to reduce their magnetic reluctance if so desired. Regarding the helical spring 30 of the translational multimpeder, while it is shown to the magnet 10, it may as well be positioned exterior to the magnet. While analyzing the multimpeder in its function as a voltage regulator and/or circuit breaker, the importance of feedback arrangements was discussed. Besides the means described so far, it is possible to implement feedback in yet another way: This consists in temporarily changing the strength B of the magnetic field by means of a coil fed by a variable current, which current will affect the magnetization of the permanent magnet itself. This coil will be included in the inner form 2 in the case of the translational multimpeder, or will be wound around a length of the horseshoe magnet 40 in the case of the rotational type. It will be appreciated that as long as the change in magnetization caused by this coil is not permitted to exceed the retentivity level of the magnetization characteristic of the permanent magnet the change itself will not be permanent.

While full and complete disclosure of the invention has been set forth in accordance with the dictates of the patent statutes, it is to be unerstood that the invention is not intended to be so limited. It will be apparent to those skilled in the art that various changes may be made to the embodiments described herein without departing from the spirit of the invention or the scope of the appended claims.

What is claimed is:

1. A multimpeder as described comprising in combination a magnet, said magnet being a permanent magnet having two opposite magnetic poles separated by an air gap, said air gap being traversed by the magnetic field created by said poles, said magnetic field being substantially orthogonal to the faces of said poles, an armature movably positioned within said air gap, said armature being equipped with a main coil capable of carrying an alternating current, said main coil being within said magnetic field, said armature and main coil being capable of a translational reciprocating motion, said motion having a direction substantially perpendicular to said magnetic field, a spring supporting said armature and resiliently opposing said armature's motion, said armature having a mass, and said spring having a resilience, said mass and said resilience being selected as to cause said armature-spring system to be maintained at a desired level of vibratory state at the frequency of said alternating current, centering means allowing said translational reciprocating motion of said armature, but preventing a motion of said armature parallel to said magnetic field, said centering means maintaining a fixed distance between said armature and said magnetic poles, said air gap being filled with a ferrofluid, said ferrofluid reducing the magnetic reluctance of said air gap, and adding a viscous force opposing said reciprocating motion of said armature.

2. The device of claim 1, with said magnet being an electromagnet, said electromagnet maintained in a state of magnetization by means of a magnetic coil fed by a direct current.

3. The device of claim 1, with said magnet being a wire wound magnet.

4. The device of claim 2, with said electromagnet being a wire wound magnet.

5. A multimpeder as described comprising in combination a magnet, said magnet being a permanent magnet having two opposite magnetic poles separated by an air gap, said air gap being traversed by the magnetic field created by said poles, said magnetic field being substantially orthogonal to the faces of said poles, an armature movably positioned within said air gap, said armature being equipped with a main coil capable of carrying an alternating current, said main coil being within said magnetic field, said armature and main coil being capable of a translational reciprocating motion, said motion having a direction substantially perpendicular to said magnetic field, a spring supporting said armature and resiliently opposing said armature's motion, said armature having a mass, and said spring having resilience, said mass and said resilience being selected as to cause said armature-spring system to be maintained at a desired level of vibratory state at the frequency of said alternating current, centering means allowing said translational reciprocating motion of said armature, but preventing a motion of said armature parallel to said magnetic field, said centering means maintaining a fixed distance between said armature and said magnetic poles, a bridge made of magnetically soft iron, said bridge being at an adjustable distance from said magnetic poles.

6. The device of claim 1, with the strength of said magnetic field within said air gap being made adjustable by means of a leakage path.

7. A multimpeder as described comprising in combination a magnet, said magnet being a permanent magnet having two opposite magnetic poles separated by an air gap, said air gap being traversed by the magnetic field created by said poles, said magnetic field being substantially orthogonal to the faces of said poles, an armature movably positioned within said air gap, said armature being equipped with a main coil capable of carrying an alternating current, said main coil being within said magnetic field, said armature and main coil being capable of a translational reciprocating motion, said motion having a direction substantially perpendicular to said magnetic field, a spring supporting said armature and resiliently opposing said armature's motion, said armature having a mass, and said spring having a resilience, said mass and said reslience being selected as to cause said aramature-spring system to be maintained at a desired level of vibratory state at the frequency of said alternating current, centering means allowing said translational reciprocating motion of said armature, but preventing a motion of said armature parallel to said magnetic field, said centering means maintaining a fixed distance between said armature and said magnetic poles, a second magnet, said second magnet being an electromagnet having opposing magnetic poles separated by an air gap traversed by a magnetic field, said electromagnet having a magnetic coil fed by a variable current, said armature and main coil being partially within said air gap of said second magnet and acted upon by said mgnetic field of said second magnet, said variable current producing the magnetic field of said second magnet, said magnetic field of said second magnet changing the effect of said permanent magnet upon said main coil and armature, said change depending upon the direction and intensity of said variable current, the arrangement of said permanent magnet, electromagnet, spring, and armature making possible a translational motion of said armature within said air gap.

8. A multimpeder as described comprising in combination a magnet having an air gap between two opposing poles, said air gap being traversed by a magnetic field, an armature translationally movable within said air gap in a reciprocating motion, a spring resiliently opposing said motion, a main coil capable of carrying an alternating current, said coil being an integral part of said armature, said magnetic field exerting a force upon said coil and armature, centering means maintaining the constancy of distance between said armature and said poles, said centering means not opposing said reciprocating motion, ferrofluid filling said air gap, said ferrofluid reducing said air gap's magnetic reluctance.

9. The device of claim 8 and, in addition, feedback means, said means controllably changing said force exerted upon said armature.

10. The magnet of claim 8, said magnet constructed by coiling a magnetizeable wire unto an inner form having the shape of a hollow torus, said coiling continuing until a toroid of sufficient thickness is built around said inner form, said toroid placed between the two halves of an outer form made of magnetizeable material, the construction of said magnet being completed by cutting a cylindrical air gap parallel to the geometric symmetry axis of said toroid through said outer form, wire mass, and inner form.

11. A multimpeder as described comprising in combination a magnet, said magnet being a permanent magnet having two opposite magnetic poles separated by an air gap, said air gap being of cylindrical shape and traversed by the magnetic field created by said magnetic poles, said magnetic field being substantially orthogonal to the faces of said poles, an armature movably positioned within said air gap, said armature being equipped with a main coil capable of carrying an alternating current, said main coil being within said magnetic field, said armature and main coil beig capable of rotational reciprocating motion, said motion being in a direction substantially orthogonal to said magnetic field, a torsion spring supporting said armature and resiliently opposing said armature's motion, said armature having an inertia, and said spring having a resilience, said inertia and said reslience being selected as to cause said armature-spring system to be maintained at a desired level of vibratory state at the frequency of said alternating current, said torsion spring allowing said rotational reciprocating motion of said armature, but preventing a translational motion of said armature within said air gap.

12. The device of claim 11, with said air gap being filled with a ferrofluid, said ferrofluid reducing the magnetic reluctance of said air gap.

13. The device of claim 11 with said magnet being an electromagnet, said electromagnet maintained in a state of magnetization by means of magnetic coil fed by a direct current.

14. The device of claim 11, with said magnet being a wire wound magnet.

15. The device of claim 13, with said electromagnet being a wire wound magnet.

16. The device of claim 11, with said torsion spring being a hollow torsion bar whose torsion constant is a function of the free length of said torsion bar, said free length being made variable by inserting a splined plunger into said hollow torsion bar, said plunger engaging telescopically the splined inner surface of said torsion bar.

17. The device of claim 11, with said torsion spring being of the leaf type.

18. The device of claim 11 and, additionally, a second magnet, said second magnet being an electromagnet having opposing magnetic poles separated by an air gap traversed by a magnetic field, said electromagnet having a magnetic coil fed by a direct current, said armature and main coil being partially within said air gap of said second magnet and acted upon by said magnetic field, said direct current producing the magnetic field of said second magnet, said magnetic field of said second magnet changing the effect of said permanent magnet upon said main coil and armature, said change depending upon the direction and intensity of said direct current, the arrangement of said permanent magnet, electromagnet, torsion spring, and armature making possible a rotational motion of said armature within said air gap.

19. A multimpeder as described comprising in combination a magnet having an air gap between two opposing poles, said air gap being traversed by a magnetic field, an armature rotationally movable within said air gap in a reciprocating rotational motion, a torsion spring resiliently opposing said motion, a main coil capable of carrying an alternating current, said coil being an integral part of said armature, said magnetic field exerting a force upon said main coil and armature, feedback means, said feedback means changing said force exerted upon said armature, and also changing the spring constant of said torsion spring.

20. A multimpeder as described comprising in combination a magnet having an air gap between two opposing poles, said air gap being traversed by a magnetic field, an armature movably positioned within said air gap, a spring resliently opposing said motion, a main coil capable of carrying an alternating current, said coil being an integral part of said armature, said magnetic field exerting a force upon said main coil and armature, feedback means, said feedback means changing said force exerted upon said armature.

21. Three identical multimpeders, each as described in claim 1, said three multimpeders so arranged in a column as to have their axes of geometric symmetry colinear, each of said multimpeders connected to a different phase of a three-phase electric power supply, said three multimpeders rigidly attached to a common support.

22. Three identical multimpeders, each as described in claim 11, said three multimpeders so arranged in a column as to have their axes of geometric symmetry colinear, each of said multimpeders connected to a different phase of a three-phase electric power supply, said three multimpeders rigidly attached to a common support.

* * * * *